US011988417B2

(12) United States Patent
Sakaguchi

(10) Patent No.: US 11,988,417 B2
(45) Date of Patent: May 21, 2024

(54) DUAL CHILLER

(71) Applicant: SMC CORPORATION, Chiyoda-ku (JP)

(72) Inventor: Tetsuo Sakaguchi, Matsudo (JP)

(73) Assignee: SMC CORPORATION, Chiyoda-ku (JP)

( * ) Notice: Subject to any disclaimer, the term of this patent is extended or adjusted under 35 U.S.C. 154(b) by 468 days.

(21) Appl. No.: 17/292,946

(22) PCT Filed: Mar. 26, 2019

(86) PCT No.: PCT/JP2019/012779
§ 371 (c)(1),
(2) Date: May 11, 2021

(87) PCT Pub. No.: WO2020/100324
PCT Pub. Date: May 22, 2020

(65) Prior Publication Data

US 2022/0003464 A1 Jan. 6, 2022

(51) Int. Cl.
*F25B 25/00* (2006.01)
*F25B 5/02* (2006.01)
(Continued)

(52) U.S. Cl.
CPC ..... *F25B 25/005* (2013.01); *F25B 5/02* (2013.01); *F25B 41/20* (2021.01); *F25B 41/40* (2021.01);
(Continued)

(58) Field of Classification Search
CPC ..... F25B 25/005; F25B 5/02; F25B 41/20; F25B 41/40; F25B 49/02; F25B 2341/06;
(Continued)

(56) References Cited

U.S. PATENT DOCUMENTS 5,406,969 A * 4/1995 Gray ..... B22D 41/14 137/340
2006/0013274 A1 1/2006 Nishikawa et al.
(Continued)

FOREIGN PATENT DOCUMENTS

CN 105659038 A 6/2016
CN 108266920 A 7/2018
(Continued)

OTHER PUBLICATIONS

WO-2010035512-A1 Translation (Year: 2010).*
(Continued)

*Primary Examiner* — David J Teitelbaum
(74) *Attorney, Agent, or Firm* — Oblon, McClelland, Maier & Neustadt, L.L.P.

(57) ABSTRACT

There are a first coolant circuit that supplies a first coolant in a first tank to a first load, a second coolant circuit that supplies a second coolant in a second tank to a second load, and a refrigeration circuit that adjusts temperatures of the first and second coolants to set temperatures by heat exchange between the first and second coolants and refrigerants by using heat exchangers. The set temperature of the second coolant is equal to the set temperature of the first coolant or higher than the set temperature of the second coolant, and the set flow rate of the first coolant is higher than the set flow rate of the second coolant, and the volume of the first tank is larger than the volume of the second tank.

4 Claims, 2 Drawing Sheets

(51) Int. Cl.
*F25B 41/20* (2021.01)
*F25B 41/40* (2021.01)
*F25B 49/02* (2006.01)

(52) U.S. Cl.
CPC ..... *F25B 49/02* (2013.01); *F25B 2341/06* (2013.01); *F25B 2400/0403* (2013.01); *F25B 2600/2501* (2013.01); *F25B 2600/2513* (2013.01); *F25B 2700/21171* (2013.01)

(58) Field of Classification Search
CPC ..... F25B 2400/0403; F25B 2600/2501; F25B 2600/2513; F25B 2700/21171
See application file for complete search history.

(56) References Cited

U.S. PATENT DOCUMENTS

| | | | | |
|---|---|---|---|---|
| 2006/0162357 | A1* | 7/2006 | Fink | F24F 3/06 62/185 |
| 2013/0098092 | A1* | 4/2013 | Wakamoto | F25B 30/02 62/278 |
| 2016/0238285 | A1 | 8/2016 | Kawano et al. | |
| 2018/0139870 | A1 | 5/2018 | Meadows et al. | |
| 2021/0116150 | A1* | 4/2021 | Uchino | B23Q 11/126 |

FOREIGN PATENT DOCUMENTS

| | | | | |
|---|---|---|---|---|
| CN | 108474594 | A | 8/2018 | |
| EP | 1 617 529 | A2 | 1/2006 | |
| EP | 1617529 | A2 * | 1/2006 | H01S 3/04 |
| JP | 62-160273 | U | 10/1987 | |
| JP | 5-17535 | Y2 | 5/1993 | |
| JP | 10-335720 | A | 12/1998 | |
| JP | 2003-294350 | A | 10/2003 | |
| JP | 2004-28554 | A | 1/2004 | |
| JP | 2006-54408 | A | 2/2006 | |
| JP | 2006-322658 | A | 11/2006 | |
| JP | 2009-63195 | A | 3/2009 | |
| JP | 2011-163698 | A | 8/2011 | |
| JP | 2012-159260 | A | 8/2012 | |
| JP | 2017-116118 | A | 6/2017 | |
| JP | 2017116118 | A * | 6/2017 | F24F 11/89 |
| WO | WO-2010035512 | A1 * | 4/2010 | F25B 29/003 |
| WO | WO 2017/110608 | A1 | 6/2017 | |

OTHER PUBLICATIONS

EP-1617529-A2 Translation (Year: 2006).*
JP-2017116118-A Translation (Year: 2017).*
International Search Report dated Jun. 18, 2019 in PCT/JP2019/012779 filed on Mar. 26, 2019, 2 pages.
Extended European Search Report dated May 18, 2022, in European Patent Application No. 19885145.3, 9 pages.
Combined Chinese Office Action and Search Report dated Jul. 12, 2022 in Chinese Patent Application No. 201980074690.6 (with English translation), 20 pages.

* cited by examiner

DUAL CHILLER

TECHNICAL FIELD

The present invention relates to a chiller that separately supplies a coolant that has an adjusted temperature to a load to keep the temperature of the load constant, and more specifically to a dual chiller that enables the temperatures of multiple loads to be kept constant.

BACKGROUND ART

As disclosed in PTL 1, a known chiller supplies a coolant that has an adjusted temperature to multiple loads to keep the temperatures of the multiple loads constant. The known chiller includes a single refrigeration circuit and two coolant circuits through which the coolant is separately supplied to two loads. Two heat exchangers are connected to the refrigeration circuit in series. One of the heat exchangers adjusts the temperature of the coolant in one of the coolant circuits, and the other heat exchanger adjusts the temperature of the coolant in the other coolant circuit.

This will be more specifically described. The known chiller adjusts the temperature of a coolant that is contained in a tank by using the heat exchangers of the refrigeration circuit and an electric heater to a set temperature and supplies the coolant that has the adjusted temperature in the tank to the loads through a supply flow path that does not extend through the heat exchangers. For this reason, in the case where the chiller measures the temperature of the coolant in the tank, and the temperature is higher than the set temperature, the coolant is supplied to the heat exchangers of the refrigeration circuit through a temperature adjustment flow path that differs from the supply flow path and returns to the tank after being cooled by the heat exchangers. In the case where the temperature of the coolant in the tank is lower than the set temperature, the coolant is heated by using the electric heater that is disposed in the tank.

The known chiller does not supply the coolant to the loads right after the temperature is adjusted by the heat exchangers and the heater but thus puts the coolant once in the tank after the temperature is adjusted and supplies the coolant to the loads from the tank. Accordingly, a difficulty lies in responsiveness to changes in the temperature of the coolant, and there is a problem in that a load variation when viewed from the refrigeration circuit is large. Since the two heat exchangers of the refrigeration circuit are connected in series, and the flow rates of refrigerants that flow through the two heat exchangers are controlled by a single expansion valve, it is difficult to separately control the flow rates and temperatures of the refrigerants that flow through the two heat exchangers so as to match the temperatures of the coolants in the respective coolant circuits connected thereto.

CITATION LIST

Patent Literature

PTL 1: Japanese Examined Utility Model Registration Application Publication No. 5-17535

SUMMARY OF INVENTION

Technical Problem

It is a technical problem of the present invention to provide a chiller that is capable of separately controlling the flow rates and temperatures of refrigerants that flow through multiple heat exchangers so as to match the temperatures of coolants in coolant circuits that are connected to the respective heat exchangers to increase responsiveness to changes in the temperatures of the coolants and the precision of temperature control.

Solution to Problem

To solve the problem, a dual chiller according to the present invention includes a first coolant circuit that supplies a first coolant to a first load at a set flow rate, a second coolant circuit that supplies a second coolant to a second load at a set flow rate, a refrigeration circuit that adjusts temperatures of the first coolant and the second coolant to set temperatures, and a control device that controls the entire chiller.

The refrigeration circuit includes a compressor that compresses a gas refrigerant into a high-temperature, high-pressure gas refrigerant, a condenser that cools the gas refrigerant supplied from the compressor into a low-temperature, high-pressure liquid refrigerant, a first main expansion valve and a second main expansion valve that cause the liquid refrigerant supplied from the condenser to expand into low-temperature, low-pressure liquid refrigerants and that have adjustable opening degrees, a first heat exchanger that exchanges heat of the liquid refrigerant supplied from the first main expansion valve with that of the first coolant in the first coolant circuit into a low-pressure gas refrigerant, and a second heat exchanger that exchanges heat of the liquid refrigerant supplied from the second main expansion valve with that of the second coolant in the second coolant circuit into a low-pressure gas refrigerant, and the first main expansion valve and the first heat exchanger are connected to each other in series and form a first heat exchange flow path portion, the second main expansion valve and the second heat exchanger are connected to each other in series and form a second heat exchange flow path portion, and the first heat exchange flow path portion and the second heat exchange flow path portion are connected to each other in parallel.

The refrigeration circuit has a first branch flow path that connects a branch point between the compressor and the condenser and a meeting point on the first heat exchange flow path portion between the first main expansion valve and the first heat exchanger to each other, and a second branch flow path that connects the branch point and a meeting point on the second heat exchange flow path portion between the second main expansion valve and the second heat exchanger to each other, a first sub expansion valve that has an adjustable opening degree is connected to the first branch flow path, and a second sub expansion valve that has an adjustable opening degree is connected to the second branch flow path.

The first coolant circuit includes a first tank that contains the first coolant, a first pump that supplies the first coolant in the first tank to the first heat exchanger through a primary supply pipeline, a secondary supply pipeline through which the first coolant that has the temperature adjusted by the first heat exchanger is supplied to the first load, a first temperature sensor that is connected to the secondary supply pipeline, a return pipeline through which the first coolant from the first load returns to the first tank, a supply load connection port that is formed in an end portion of the secondary supply pipeline, and a return load connection port that is formed in an end portion of the return pipeline.

The second coolant circuit includes a second tank that contains the second coolant, a second pump that supplies the second coolant in the second tank to the second heat exchanger through the primary supply pipeline, a secondary supply pipeline through which the second coolant that has the temperature adjusted by the second heat exchanger is supplied to the second load, a second temperature sensor that is connected to the secondary supply pipeline, a return pipeline through which the second coolant from the second load returns to the second tank, a supply load connection port that is formed in an end portion of the secondary supply pipeline, and a return load connection port that is formed in an end portion of the return pipeline.

The set temperature of the first coolant is equal to the set temperature of the first coolant or higher than the set temperature of the second coolant, the set flow rate of the first coolant is higher than the set flow rate of the second coolant, and a volume of the first tank is larger than a volume of the second tank.

According to the present invention, the second coolant circuit preferably includes a conductivity adjustment mechanism for adjusting electrical conductivity of the second coolant, the conductivity adjustment mechanism preferably includes a DI filter for removing an ionic substance in the second coolant, a conductivity sensor for measuring the electrical conductivity of the second coolant, and a solenoid valve that opens or closes depending on the electrical conductivity that is measured by the conductivity sensor, the DI filter and the solenoid valve are preferably connected to a filtration pipeline that connects the secondary supply pipeline and the return pipeline of the second coolant circuit to each other, and the conductivity sensor is preferably connected to the return pipeline of the second coolant circuit.

According to the present invention, the refrigeration circuit, the first coolant circuit, and the second coolant circuit may be contained in a housing, the supply load connection port and the return load connection port of the first coolant circuit and the supply load connection port and the return load connection port of the second coolant circuit may be located outside the housing, the first coolant circuit and the second coolant circuit may include a first filter and a second filter for removing physical impurities that are contained in the first coolant and the second coolant, and the first filter and the second filter may be mounted on the respective supply load connection ports of the first coolant circuit and the second coolant circuit outside the housing.

According to the present invention, the control device may adjust flow rates of the low-temperature refrigerant and the high-temperature refrigerant that flow into the first heat exchanger and the second heat exchanger by correlatively adjusting the opening degrees of the first main expansion valve and the first sub expansion valve that are connected to the first heat exchanger, and the opening degrees of the second sub expansion valve and the second main expansion valve that are connected to the second heat exchanger, based on temperatures of the first coolant and the second coolant that are measured by the first temperature sensor of the first coolant circuit and the second temperature sensor of the second coolant circuit, such that the temperatures of the first coolant and the second coolant in the first coolant circuit and the second coolant circuit are held at the set temperatures.

According to the present invention, the first pump of the first coolant circuit is preferably an immersion pump that is disposed in the first tank, and the second pump of the second coolant circuit is preferably a non-immersion pump that is disposed outside the second tank.

Advantageous Effects of Invention

In the chiller according to the present invention, the two heat exchangers are connected to the refrigeration circuit in parallel, the main expansion valves from which the low-temperature refrigerants are supplied and the sub expansion valves from which the high-temperature refrigerants are supplied are connected to the respective heat exchangers, and the cooling capacities of the heat exchangers can be separately adjusted depending on the temperatures of the coolants in the two coolant circuits that are connected to the heat exchangers by correlatively adjusting the opening degrees of the expansion valves. Accordingly, responsiveness to changes in the temperatures of the coolants is excellent, and the precision of temperature control is high. In addition, it is not necessary to heat the coolants by an electric heater, and accordingly, the power consumption is low. Furthermore, a chiller that is optimum for cooling two loads that have different temperatures such as a laser oscillator and a probe in a laser welding apparatus can be obtained in a manner in which the set temperatures and set flow rates of the coolants in the two coolant circuits are set to values that differ from each other.

DESCRIPTION OF EMBODIMENTS

Figure 1:
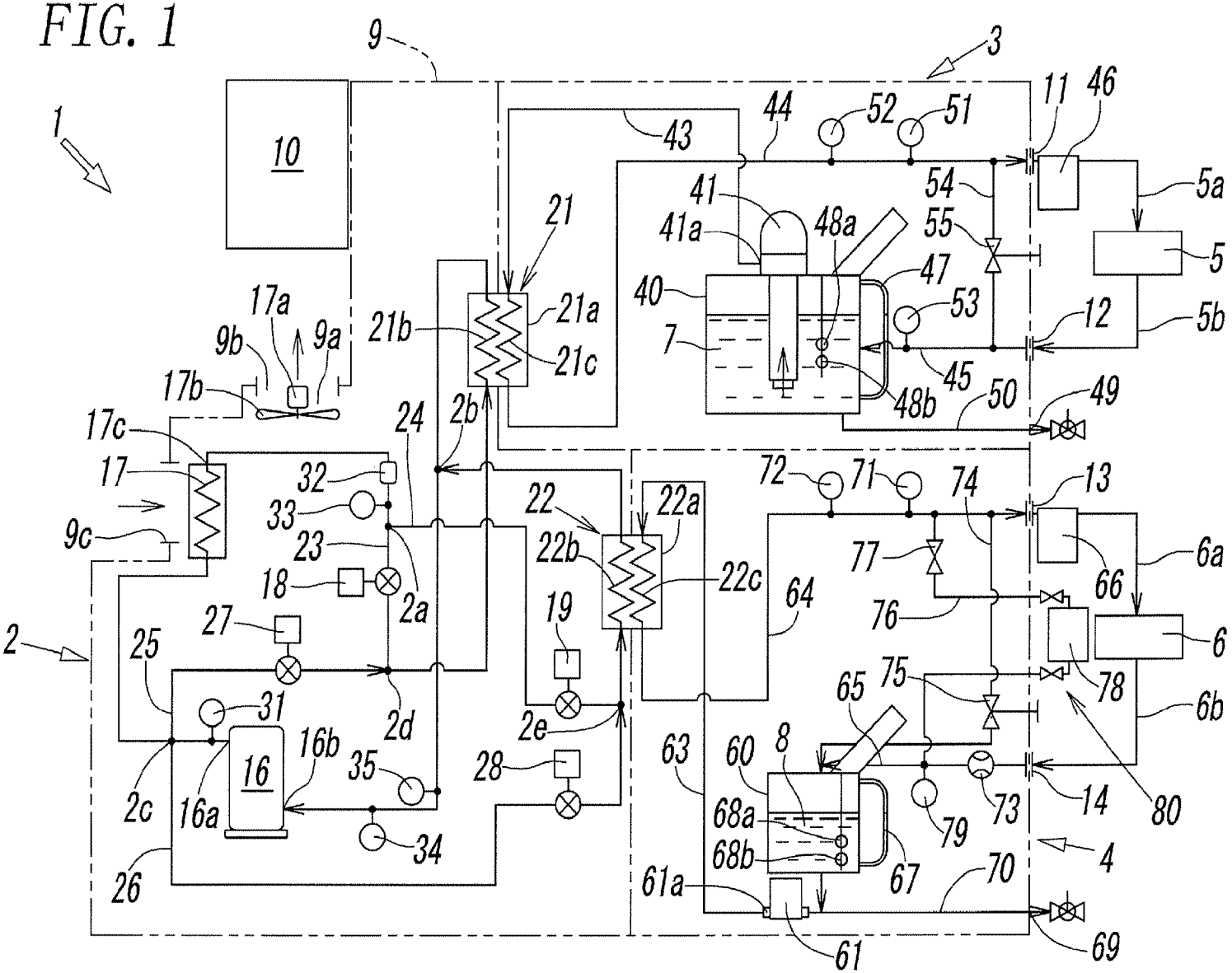
FIG. 1 is a circuit diagram illustrating a dual chiller according to an embodiment of the present invention by using symbols.

A dual chiller (simply referred to below as a "chiller") 1 illustrated in FIG. 1 keeps the temperatures of two loads 5 and 6 constant and includes two coolant circuits 3 and 4, a single refrigeration circuit 2, and a control device 10 that controls the entire chiller. The two coolant circuits 3 and 4 separately supply coolants 7 and 8 to the two loads 5 and 6 in a circulation manner and cool the loads 5 and 6. The refrigeration circuit 2 adjusts the temperatures of the coolants 7 and 8 in the two coolant circuits 3 and 4 by heat exchange with a refrigerant and hold the temperatures of the coolants 7 and 8 at set temperatures.

According to an embodiment illustrated, the first load 5 of the two loads 5 and 6 is a laser oscillator in a laser welding apparatus and is a load that has a low temperature. The second load 6 is a probe that emits laser light and is a load that has a high temperature. The first coolant circuit 3 cools the first load 5 by using the first coolant 7. The second coolant circuit 4 cools the second load 6 by using the second coolant 8.

In this case, the first coolant 7 that is supplied to the first load 5 is, for example, clear water, the temperature of the clear water is set to the optimum temperature within a range of 10 to 30° C., preferably a range of 15 to 25° C., and the flow rate of the clear water is set to the optimum flow rate within a range of 20 to 80 L/min. The second coolant 8 that is supplied to the second load 6 is pure water, the temperature of the pure water is set to the optimum temperature within a range of 10 to 50° C., preferably a range of 20 to 40° C., and the flow rate of the pure water is set to the optimum flow rate within a range of 2 to 10 L/min. The set temperature of the second coolant 8 needs to be equal to the set temperature of the first coolant 7 or higher than the set temperature of the first coolant 7.

The pure water is high purity water from which all of salts and organic substances, for example, are removed and includes ultrapure water. The clear water is water other than the pure water and is preferably water the quality of which is managed so as to be suitable to cool the load but may be tap water or industrial water.

The refrigeration circuit 2 and the first coolant circuit 3 and the second coolant circuit 4 are contained in a single housing 9. The first load 5 and the second load 6 are disposed outside the housing 9. Two load connection ports 11 and 12 for connecting the first load 5 to the first coolant circuit 3 and two load connection ports 13 and 14 for connecting the second load 6 to the second coolant circuit 4 are formed in an outer side of the housing 9.

The refrigeration circuit 2 is formed by using a pipe to sequentially connect, in series and into a loop, a compressor 16 that compresses a gas refrigerant into a high-temperature, high-pressure gas refrigerant, a condenser 17 that cools the high-temperature, high-pressure gas refrigerant that is supplied from the compressor 16 into a low-temperature, high-pressure liquid refrigerant, a first main expansion valve 18 and a second main expansion valve 19 that cause the low-temperature, high-pressure liquid refrigerant that is supplied from the condenser 17 to expand into low-temperature, low-pressure liquid refrigerants, and a first heat exchanger 21 and a second heat exchanger 22 that separately exchange heat of the low-temperature, low-pressure liquid refrigerants that are supplied from the first main expansion valve 18 and the second main expansion valve 19 with that of the first coolant 7 in the first coolant circuit 3 and the second coolant 8 in the second coolant circuit 4 into low-pressure gas refrigerants.

The first main expansion valve 18 and the first heat exchanger 21 are connected to each other in series and form a first heat exchange flow path portion 23. The second main expansion valve 19 and the second heat exchanger 22 are connected to each other in series and form a second heat exchange flow path portion 24. The first heat exchange flow path portion 23 and the second heat exchange flow path portion 24 are connected to each other in parallel such that these branch at a branch point 2*a* and meet each other at a meeting point 2*b* within a circuit portion from the exit of the condenser 17 to an inhalation port 16*b* of the compressor 16.

The first heat exchanger 21 includes a refrigerant flowing portion 21*b* through which the refrigerant flows and a coolant flowing portion 21*c* through which the coolant 7 flows in a case 21*a* and exchanges heat between the refrigerant that flows in the refrigerant flowing portion 21*b* and the coolant 7 that flows in the coolant flowing portion 21*c*. Similarly, the second heat exchanger 22 includes a refrigerant flowing portion 22*b* through which the refrigerant flows and a coolant flowing portion 22*c* through which the coolant 8 flows in a case 22*a* and exchanges heat between the refrigerant that flows in the refrigerant flowing portion 22*b* and the coolant 8 that flows in the coolant flowing portion 22*c*.

The flow rates of the refrigerants that flow through the refrigerant flowing portion 21*b* of the first heat exchanger 21 and the refrigerant flowing portion 22*b* of the second heat exchanger 22 increase or decrease with increases or decreases in the opening degrees of the first main expansion valve 18 and the second main expansion valve 19, and the cooling capacities of the first heat exchanger 21 and the second heat exchanger 22 are consequently adjusted. The first main expansion valve 18 and the second main expansion valve 19 from which the low-temperature refrigerants are supplied to the first heat exchanger 21 and the second heat exchanger 22 can be referred to as expansion valves for cooling.

One end and the other end of a first branch flow path 25 are connected to a branch point 2*c* on the refrigeration circuit 2 between a discharge port 16*a* of the compressor 16 and the condenser 17 and a meeting point 2*d* on the first heat exchange flow path portion 23 between the first main expansion valve 18 and the first heat exchanger 21. One end and the other end of a second branch flow path 26 are connected to the branch point 2*c* and a meeting point 2*e* on the second heat exchange flow path portion 24 between the second main expansion valve 19 and the second heat exchanger 22. A first sub expansion valve 27 is connected to the first branch flow path 25. A second sub expansion valve 28 is connected to the second branch flow path 26.

Through the first branch flow path 25 and the second branch flow path 26, parts of the high-temperature gas refrigerant that is discharged from the compressor 16 are supplied as refrigerants for heating to the first heat exchange flow path portion 23 and the second heat exchange flow path portion 24. As a result of the supply of the refrigerants for heating, the temperatures of the refrigerants that flow toward the first heat exchanger 21 and the second heat exchanger 22 in the first heat exchange flow path portion 23 and the second heat exchange flow path portion 24 are adjusted, and the cooling capacities of the first heat exchanger 21 and the second heat exchanger 22 are consequently adjusted. The flow rates of the refrigerants for heating increase or decrease with increases or decreases in the opening degrees of the first sub expansion valve 27 and the second sub expansion valve 28, and the temperatures of the refrigerants that flow toward the first heat exchanger 21 and the second heat exchanger 22 are consequently adjusted. Accordingly, the first sub expansion valve 27 and the second sub expansion valve 28 can be referred to as expansion valves for heating.

The first main expansion valve 18, the second main expansion valve 19, the first sub expansion valve 27, and the second sub expansion valve 28 are electronic expansion valves each of which can freely adjust the opening degree by using a stepper motor in a range of a fully closed state to a fully opened state. The expansion valves are electrically connected to the control device 10, and the opening degree of each expansion valve is controlled by the control device 10.

The condenser 17 is an air-cooled condenser that cools the refrigerant by using a fan 17*b* that is driven by an electric motor 17*a*. The fan 17*b* is disposed in a fan container 9*a* that is formed on the upper surface of the housing 9. The fan container 9*a* has an exhaust port 9*b* that discharges cooling air upward. An intake port 9*c* through which outdoor air is taken in as cooling air is formed in a side surface of the housing 9 so as to face the condenser 17. The cooling air that is taken in through the intake port 9*c* cools the refrigerant when passing through the condenser 17 and is subsequently discharged from the exhaust port 9*b* to a location outside the housing 9. The compressor 16 and the fan 17*b* are electrically connected to the control device 10, and the rotational speed and output thereof, for example, are controlled by inverter control of the control device 10. However, the condenser 17 may be a water-cooled condenser.

A first refrigerant temperature sensor 31 that measures the temperature of the refrigerant that is discharged from the compressor 16 is connected to the refrigeration circuit 2 at a portion extending from the discharge port 16*a* of the compressor 16 to the branch point 2*c*. A filter 32 that filters impurities in the refrigerant and a first refrigerant pressure sensor 33 that measures the pressure of the refrigerant are sequentially connected to a portion extending from an exit 17*c* of the condenser 17 to the branch point 2*a* at which the first heat exchange flow path portion 23 and the second heat exchange flow path portion 24 branch. A second refrigerant temperature sensor 34 that measures the temperature of the refrigerant that is taken in the compressor 16 and a second refrigerant pressure sensor 35 that measures the pressure of the refrigerant are connected to a portion extending from the meeting point 2*b* between the first heat exchange flow path portion 23 and the second heat exchange flow path portion 24 to the inhalation port 16*b* of the compressor 16. The first and second refrigerant temperature sensors 31 and 34 and the first and second refrigerant pressure sensors 33 and 35 are electrically connected to the control device 10. The rotational speeds and outputs of the compressor 16 and the electric motor 17*a* of the condenser 17, for example, are controlled by the control device 10, based on the results of measurement thereof.

In the refrigeration circuit 2, portions from the discharge port 16*a* of the compressor 16 to the first main expansion valve 18 and the second main expansion valve 19 through the condenser 17 are high-pressure portions at which the pressure of the refrigerant is high. However, portions from the exits of the first main expansion valve 18 and the second main expansion valve 19 to the inhalation port 16*b* of the compressor 16 through the first heat exchanger 21 and the second heat exchanger 22 are low-pressure portions at which the pressure of the refrigerant is low.

The first coolant circuit 3 includes a first tank 40 that contains the first coolant 7, an immersion first pump 41 that is disposed in the first tank 40, a primary supply pipeline 43 that connects a discharge port 41*a* of the first pump 41 and the entrance of the coolant flowing portion 21*c* of the first heat exchanger 21 to each other, a secondary supply pipeline 44 that connects the exit of the coolant flowing portion 21*c* and the supply load connection port 11 to each other, and a return pipeline 45 that connects the return load connection port 12 and the first tank 40 to each other. A supply load pipe 5*a* and a return load pipe 5*b* of the first load 5 are connected to the supply load connection port 11 and the return load connection port 12. With this, the first coolant 7 in the first tank 40 is supplied by the first coolant circuit 3 to the coolant flowing portion 21*c* of the first heat exchanger 21 by using the first pump 41 and is supplied to the first load 5 through the secondary supply pipeline 44 right after heat is exchanged with the refrigerant that flows in the refrigerant flowing portion 21*b* at the coolant flowing portion 21*c* to adjust the temperature to the set temperature.

A first filter 46 for removing physical impurities in the first coolant 7 is mounted on the load connection port 11, and the first coolant 7 is supplied to the first load 5 through the first filter 46. The first filter 46 is disposed outside the housing 9 but may be disposed in the housing 9.

The first tank 40 includes a liquid level gauge 47 for monitoring the liquid level of the first coolant 7 from the outside, and level switches 48*a* and 48*b* for detecting the upper limit and lower limit of the liquid level. A drain tube 50 in communication with a drain port 49 that is formed in the outer surface of the housing 9 is connected. However, an electric heater for adjusting the temperature of the first coolant 7 is not disposed in the first tank 40.

A first temperature sensor 51 that measures the temperature of the first coolant 7, which flows toward the first load 5 after the temperature is adjusted by the first heat exchanger 21, and a first pressure sensor 52 that measures the pressure of the first coolant 7 are connected to the secondary supply pipeline 44. A return temperature sensor 53 that measures the temperature of the first coolant 7 that flows from the first load 5 toward the first tank 40 is connected to the return pipeline 45. The first temperature sensor 51, the return temperature sensor 53, and the first pressure sensor 52 are electrically connected to the control device 10. The control device 10 controls, for example, the first pump 41 and the expansion valves 18, 19, 27, and 28 of the refrigeration circuit 2, based on, for example, the measured temperature or pressure of the first coolant 7.

A bypass pipeline 54 for flow rate adjustment is connected to the secondary supply pipeline 44 and the return pipeline 45. The bypass pipeline 54 is connected to the secondary supply pipeline 44 at a position between the load connection port 11 and the first temperature sensor 51 and to the return pipeline 45 at a position between the load connection port 12 and the return temperature sensor 53. A two-way valve 55 that has an adjustable opening degree and that is manually opened or closed is connected to the bypass pipeline 54.

A part of the first coolant 7 that flows through the secondary supply pipeline 44 is separated by the bypass pipeline 54 and flows into the return pipeline 45, and the flow rate of the first coolant 7 that is supplied from the secondary supply pipeline 44 to the first load 5 can be consequently adjusted to a flow rate that is optimum for cooling the first load 5. While the two-way valve 55 is fully closed, the first coolant 7 does not flow through the bypass pipeline 54, and the entire first coolant 7 is supplied to the first load 5.

The second coolant circuit 4 includes a second tank 60 that contains the second coolant 8, a non-immersion second pump 61 that is disposed outside the second tank 60, a primary supply pipeline 63 that connects a discharge port 61*a* of the second pump 61 and the entrance of the coolant flowing portion 22*c* of the second heat exchanger 22 to each other, a secondary supply pipeline 64 that connects the exit of the coolant flowing portion 22*c* and the supply load connection port 13 to each other, and a return pipeline 65 that connects the return load connection port 14 and the second tank 60 to each other. A supply load pipe 6*a* and a return load pipe 6*b* of the second load 6 are connected to the supply load connection port 13 and the return load connection port 14. The second coolant 8 in the second tank 60 is consequently supplied by the second coolant circuit 4 to the coolant flowing portion 22*c* of the second heat exchanger 22 by using the second pump 61 and is supplied to the second load 6 through the secondary supply pipeline 64 right after heat is exchanged with the refrigerant that flows in the refrigerant flowing portion 22*b* at the coolant flowing portion 22*c* to adjust the temperature to the set temperature.

The volume of the first tank 40 in the first coolant circuit 3 is larger than the volume of the second tank 60 in the second coolant circuit 4. According to the embodiment illustrated, the volume of the first tank 40 is 60 L, and the volume of the second tank 60 is 7 L. However, the volumes of the first tank 40 and the second tank 60 may be larger or smaller than these.

A second filter 66 for removing physical impurities in the second coolant 8 is disposed at the supply load connection port 13, and the second coolant 8 is supplied to the second load 6 through the second filter 66. The second filter 66 is disposed outside the housing 9 but may be disposed in the housing 9.

The second tank 60 includes a liquid level gauge 67 for monitoring the liquid level of the second coolant 8 from the outside, and level switches 68*a* and 68*b* for detecting the upper limit and lower limit of the liquid level. A drain tube 70 in communication with a drain port 69 that is formed in the outer surface of the housing 9 is connected. However, an electric heater for adjusting the temperature of the second coolant 8 is not disposed in the second tank 60.

A second temperature sensor 71 that measures the temperature of the second coolant 8 that flows toward the second load 6 after the temperature is adjusted by the second heat exchanger 22, and a second pressure sensor 72 that measures the pressure of the second coolant 8 are connected to the secondary supply pipeline 64. A flow meter 73 that measures the flow rate of the second coolant 8 that flows from the second load 6 toward the second tank 60 is connected to the return pipeline 65. The second temperature sensor 71, the second pressure sensor 72, and the flow meter 73 are electrically connected to the control device 10. The control device 10 controls, for example, the second pump 61, the expansion valves 18, 19, 27, and 28 of the refrigeration circuit 2, based on, for example, the measured temperature, pressure, or flow rate of the second coolant 8.

A bypass pipeline 74 and a filtration pipeline 76 are connected to the secondary supply pipeline 64 and the return pipeline 65. The bypass pipeline 74 and the filtration pipeline 76 are connected to the secondary supply pipeline 64 at positions between the load connection port 13 and the second temperature sensor 71 and to the return pipeline 65 at positions between the flow meter 73 and the second tank 60 such that these are in parallel with each other.

A two-way valve 75 that is manually opened or closed is connected to the bypass pipeline 74. A part of the second coolant 8 that flows through the secondary supply pipeline 64 is separated by adjusting the opening degree of the two-way valve 75 and flows into the return pipeline 65, and the flow rate of the second coolant 8 that is supplied from the secondary supply pipeline 64 to the second load 6 can be consequently adjusted to a flow rate that is optimum for the second load 6.

The filtration pipeline 76 is a pipeline for removing ionic substances in the second coolant (pure water) 8. A two-way solenoid valve 77 and a DI filter 78 are connected to the filtration pipeline 76 in series. A conductivity sensor 79 that measures the electrical conductivity of the second coolant 8 is connected to a meeting point between the filtration pipeline 76 and the return pipeline 65. The two-way solenoid valve 77, the DI filter 78, and the conductivity sensor 79 are included in a conductivity adjustment mechanism 80.

The filtration pipeline 76 is typically closed by closing the two-way solenoid valve 77. However, when the conductivity sensor 79 detects that the electrical conductivity of the second coolant 8 increases as the amount of the ionic substances in the second coolant 8 increases, the filtration pipeline 76 is opened by opening the two-way solenoid valve 77, the second coolant 8 in the secondary supply pipeline 64 is caused to flow into the return pipeline 65 through the DI filter 78 and returns to the second tank 60. The ionic substances in the second coolant 8 consequently adsorb on a resin surface in the DI filter 78 due to ion exchange and are removed.

Figure 2:
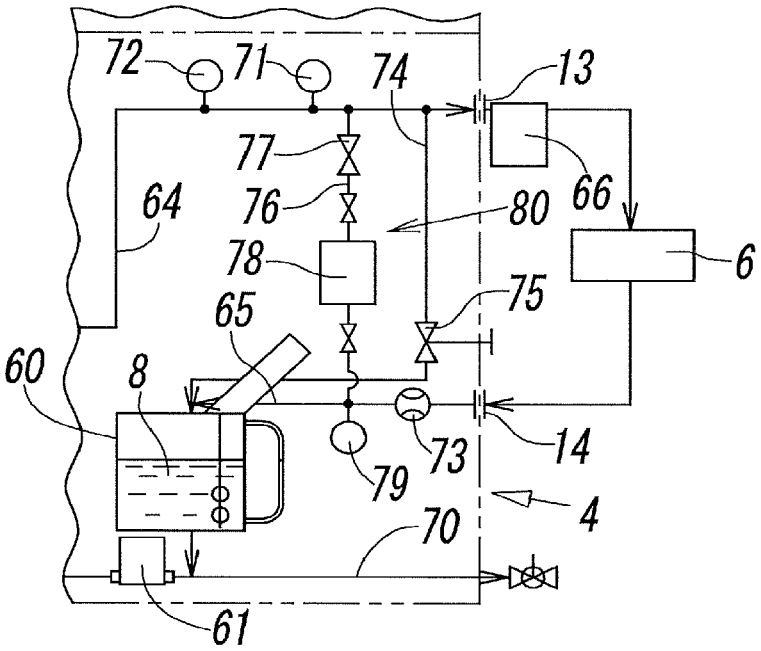
FIG. 2 is a circuit diagram illustrating a principal part of a dual chiller according to another embodiment of the present invention.

According to the embodiment in FIG. 1, the DI filter 78 is disposed outside the housing 9. As illustrated in FIG. 2, however, the DI filter 78 is preferably disposed in the housing 9.

The chiller 1 that has the structure operates as follows. In the refrigeration circuit 2, the high-temperature, high-pressure gas refrigerant that is discharged from the compressor 16 is cooled by the condenser 17 into the low-temperature, high-pressure liquid refrigerant and is subsequently separated at the branch point 2*a* and flows into the first heat exchange flow path portion 23 and the second heat exchange flow path portion 24. The liquid refrigerant that flows into the first heat exchange flow path portion 23 becomes the low-temperature, low-pressure liquid refrigerant at the first main expansion valve 18, is subsequently heated by cooling the first coolant 7 in the first coolant circuit 3 in the first heat exchanger 21, and vaporizes into the low-pressure gas refrigerant. The liquid refrigerant that flows into the second heat exchange flow path portion 24 becomes the low-temperature, low-pressure liquid refrigerant at the second main expansion valve 19, is subsequently heated by cooling the second coolant 8 in the second coolant circuit 4 in the second heat exchanger 22, and vaporizes into the low-pressure gas refrigerant. The gas refrigerants that exit from the first heat exchanger 21 and the second heat exchanger 22 meet each other at the meeting point 2*b* and flow into the inhalation port 16*b* of the compressor 16.

Parts of the high-temperature, high-pressure gas refrigerant that is discharged from the compressor 16 are supplied as the refrigerants for heating to the first heat exchange flow path portion 23 and the second heat exchange flow path portion 24 through the first branch flow path 25 and the second branch flow path 26. As a result of the supply of the refrigerants for heating, the temperatures of the refrigerants that flow toward the first heat exchanger 21 and the second heat exchanger 22 in the first heat exchange flow path portion 23 and the second heat exchange flow path portion 24 are adjusted, and the cooling capacities of the first heat exchanger 21 and the second heat exchanger 22 are consequently adjusted.

In the first coolant circuit 3, the first coolant 7 in the first tank 40 is supplied from the first pump 41 to the coolant flowing portion 21*c* of the first heat exchanger 21 through the primary supply pipeline 43, is supplied from the secondary supply pipeline 44 to the first load 5 through the supply load connection port 11 after the temperature is adjusted to the set temperature by heat exchange with the refrigerant in the refrigeration circuit 2 by using the first heat exchanger 21, and cools the first load 5. At this time, in the case where it is necessary to adjust the flow rate of the first coolant 7 that is supplied to the first load 5, the two-way valve 55 is opened, and a part of the first coolant 7 is separated and flows into the return pipeline 45 through the bypass pipeline 54. The first coolant 7 heated by cooling the first load 5 returns from the return load connection port 12 to the first tank 40 through the return pipeline 45.

The temperature of the first coolant 7 is always measured by the supply first temperature sensor 51 and the return temperature sensor 53. The opening degrees of the first main expansion valve 18 and the first sub expansion valve 27 of the refrigeration circuit 2 are controlled based on the measured temperature of the first coolant 7, and the temperature of the first coolant 7 is finely adjusted and is held at the set temperature.

For example, in the case where the temperature of the first coolant 7 that is measured by the first temperature sensor 51 is higher than the set temperature, it is necessary to decrease the temperature of the first coolant 7 by increasing the cooling capacity of the first heat exchanger 21. Accordingly, the opening degree of the first main expansion valve 18 in the refrigeration circuit 2 increases, the flow rate of the low-temperature refrigerant that flows through the first heat exchange flow path portion 23 increases, the opening degree of the first sub expansion valve 27 decreases, and the flow rate of the high-temperature refrigerant for heating that flows from the first branch flow path 25 into the first heat exchange flow path portion 23 decreases. Consequently, the temperature of the refrigerant that flows into the first heat exchanger 21 deceases, and the cooling capacity of the first heat exchanger 21 increases. Accordingly, the first coolant 7 is cooled, and the temperature thereof decreases and is held at the set temperature.

In contrast, in the case where the temperature of the first coolant 7 is lower than the set temperature, it is necessary to increase the temperature by heating the first coolant 7 by using the first heat exchanger 21. Accordingly, the opening degree of the first main expansion valve 18 decreases, the flow rate of the low-temperature refrigerant that flows through the first heat exchange flow path portion 23 decreases, the opening degree of the first sub expansion valve 27 increases, and the flow rate of the high-temperature refrigerant for heating that flows from the first branch flow path 25 into the first heat exchange flow path portion 23 increases. Consequently, the temperature of the refrigerant that flows into the first heat exchanger 21 increases, and the first coolant 7 is heated by the heated refrigerant. Accordingly, the temperature of the first coolant 7 increases and is held at the set temperature. In this case, it is not necessary for the first tank 40 to include an electric heater to heat the first coolant 7 in order to increase the temperature of the first coolant 7 unlike an existing chiller, and power consumption decreases accordingly.

In the second coolant circuit 4, the second coolant 8 in the second tank 60 is supplied from the second pump 61 to the coolant flowing portion 22*c* of the second heat exchanger 22 through the primary supply pipeline 63, is supplied from the secondary supply pipeline 64 to the second load 6 through the supply load connection port 13 after the temperature is adjusted to the set temperature by heat exchange with the refrigerant in the refrigeration circuit 2 by using the second heat exchanger 22, and cools the second load 6. At this time, in the case where it is necessary to adjust the flow rate of the second coolant 8 that is supplied to the second load 6, the two-way valve 75 is opened, and a part of the second coolant 8 is separated and flows into the return pipeline 65 through the bypass pipeline 74. The second coolant 8 heated by cooling the second load 6 returns from the return load connection port 14 to the second tank 60 through the return pipeline 65.

The temperature of the second coolant 8 is always measured by the second temperature sensor 71. The opening degrees of the expansion valves 19 and 28 of the refrigeration circuit 2 are controlled based on the measured temperature of the second coolant 8, and the temperature of the second coolant 8 is finely adjusted and is held at the set temperature.

For example, in the case where the temperature of the second coolant 8 that is measured by the second temperature sensor 71 is higher than the set temperature, it is necessary to decrease the temperature of the second coolant 8 by increasing the cooling capacity of the second heat exchanger 22. Accordingly, the opening degree of the second main expansion valve 19 in the refrigeration circuit 2 increases, the flow rate of the low-temperature refrigerant that flows through the second heat exchange flow path portion 24 increases, the opening degree of the second sub expansion valve 28 decreases, and the flow rate of the high-temperature refrigerant for heating that flows from the second branch flow path 26 into the second heat exchange flow path portion 24 decreases. Consequently, the temperature of the refrigerant that flows into the second heat exchanger 22 deceases, and the cooling capacity of the second heat exchanger 22 increases. Accordingly, the second coolant 8 is cooled, and the temperature thereof decreases and is held at the set temperature.

In contrast, in the case where the temperature of the second coolant 8 is lower than the set temperature, it is necessary to increase the temperature by heating the second coolant 8 by using the second heat exchanger 22. Accordingly, the opening degree of the second main expansion valve 19 decreases, the flow rate of the low-temperature refrigerant that flows through the second heat exchange flow path portion 24 decreases, the opening degree of the second sub expansion valve 28 increases, and the flow rate of the high-temperature refrigerant for heating that flows from the second branch flow path 26 into the second heat exchange flow path portion 24 increases. Consequently, the temperature of the refrigerant that flows into the second heat exchanger 22 increases, and the second coolant 8 is heated by the heated refrigerant. Accordingly, the temperature of the second coolant 8 increases and is held at the set temperature. In this case, it is not necessary for the second tank 60 to include an electric heater to heat the second coolant 8 in order to increase the temperature of the second coolant 8 unlike the existing chiller, and the power consumption decreases accordingly.

The electrical conductivity of the second coolant 8 that is measured by the conductivity sensor 79 increases with an increase in the amount of the ionic substances in the second coolant 8. Accordingly, the two-way solenoid valve 77 opens, the filtration pipeline 76 opens, the second coolant 8 flows through the filtration pipeline 76, and the ionic substances in the second coolant 8 are consequently removed by the DI filter 78. At this time, while the second load 6 continues to be cooled, a part of the second coolant 8 can be caused to flow through the filtration pipeline 76 and filtered, or while cooling of the second load 6 is stopped, the entire second coolant 8 can be caused to flow through the filtration pipeline 76 and filtered.

In the chiller 1, the first heat exchanger 21 and the second heat exchanger 22 are connected to the refrigeration circuit 2 in parallel, the first main expansion valve 18 and the second main expansion valve 19 for cooling, from which the low-temperature refrigerants are supplied, and the first sub expansion valve 27 and the second sub expansion valve 28 for heating, from which the high-temperature refrigerants are supplied, are connected to the first heat exchanger 21 and the second heat exchanger 22, and the opening degrees of the first main expansion valve 18 and the second main expansion valve 19 for cooling and the first sub expansion valve 27 and the second sub expansion valve 28 for heating are correlatively adjusted, as. In this way, the different heat exchangers 21 and 22 are used for cooling and heating, and the temperatures of the coolants 7 and 8 in the coolant circuits 3 and 4 that are connected to the heat exchangers 21 and 22 are separately adjusted. Accordingly, responsiveness to changes in the temperatures of the coolants 7 and 8 is excellent, and the precision of temperature control is high. In addition, it is not necessary to heat the coolants 7 and 8 by using an electric heater, and the power consumption is low. Furthermore, a chiller that is suitable to cool two loads that have different temperatures such as a laser oscillator and a probe in a laser welding apparatus can be obtained in a manner in which the set temperatures and set flow rates of the first coolant 7 and the second coolant 8 are set to values that differ from each other.

According to the embodiment, clear water is used as the first coolant 7. However, pure water may be used as the first coolant 7. Alternatively, ethylene glycol can be used as at least the second coolant of the first coolant 7 and the second coolant 8.

REFERENCE SIGNS LIST

1 chiller
2 refrigeration circuit
2*c* branch point
2*d*, 2*e* meeting point
3 first coolant circuit
4 second coolant circuit
5 first load
6 second load
7 first coolant
8 second coolant
9 housing
10 control device
11, 13 supply load connection port
12, 14 return load connection port
16 compressor
17 condenser
18 first main expansion valve
19 second main expansion valve
21 first heat exchanger
22 second heat exchanger
23 first heat exchange flow path portion
24 second heat exchange flow path portion
25 first branch flow path
26 second branch flow path
27 first sub expansion valve
28 second sub expansion valve
40 first tank
41 first pump
43 primary supply pipeline
44 secondary supply pipeline
45 return pipeline
46 first filter
51 first temperature sensor
60 second tank
61 second pump
63 primary supply pipeline
64 secondary supply pipeline
65 return pipeline
66 second filter
71 second temperature sensor
76 filtration pipeline
77 two-way solenoid valve
78 DI filter
79 conductivity sensor
80 conductivity adjustment mechanism

The invention claimed is:

1. A dual chiller, comprising:

a first coolant circuit that supplies a first coolant to a first load at a set flow rate; a second coolant circuit that supplies a second coolant to a second load at a set flow rate; a refrigeration circuit that adjusts temperatures of the first coolant and the second coolant to set temperatures; and a control device that controls the chiller, wherein the refrigeration circuit includes a compressor that compresses a gas refrigerant into a high-temperature, high-pressure gas refrigerant, a condenser that cools the gas refrigerant supplied from the compressor into a low-temperature, high-pressure liquid refrigerant, a first main expansion valve and a second main expansion valve that cause the liquid refrigerant supplied from the condenser to expand into low-temperature, low-pressure liquid refrigerants and that have adjustable opening degrees, a first heat exchanger that exchanges heat of the liquid refrigerant supplied from the first main expansion valve with that of the first coolant in the first coolant circuit into a low-pressure gas refrigerant, and a second heat exchanger that exchanges heat of the liquid refrigerant supplied from the second main expansion valve with that of the second coolant in the second coolant circuit into a low-pressure gas refrigerant, and the first main expansion valve and the first heat exchanger are connected to each other in series and form a first heat exchange flow path portion, the second main expansion valve and the second heat exchanger are connected to each other in series and form a second heat exchange flow path portion, and the first heat exchange flow path portion and the second heat exchange flow path portion are connected to each other in parallel, wherein the refrigeration circuit has a first branch flow path that connects a branch point between the compressor and the condenser and a meeting point on the first heat exchange flow path portion between the first main expansion valve and the first heat exchanger to each other, and a second branch flow path that connects the branch point and a meeting point on the second heat exchange flow path portion between the second main expansion valve and the second heat exchanger to each other, a first sub expansion valve that has an adjustable opening degree is connected to the first branch flow path, and a second sub expansion valve that has an adjustable opening degree is connected to the second branch flow path, wherein the first coolant circuit includes a first tank that contains the first coolant, a first pump that supplies the first coolant in the first tank to the first heat exchanger through a primary supply pipeline, a secondary supply pipeline through which the first coolant that has the temperature adjusted by the first heat exchanger is supplied to the first load, a first temperature sensor that is connected to the secondary supply pipeline, a return pipeline through which the first coolant from the first load returns to the first tank, a supply load connection port that is formed in an end portion of the secondary supply pipeline, and a return load connection port that is formed in an end portion of the return pipeline, wherein the second coolant circuit includes a second tank that contains the second coolant, a second pump that supplies the second coolant in the second tank to the second heat exchanger through a primary supply pipeline, a secondary supply pipeline through which the second coolant that has the temperature adjusted by the second heat exchanger is supplied to the second load, a second temperature sensor that is connected to the secondary supply pipeline, a return pipeline through which the second coolant from the second load returns to the second tank, a supply load connection port that is formed in an end portion of the secondary supply pipeline, and a return load connection port that is formed in an end portion of the return pipeline, wherein the set temperature of the second coolant is equal to the set temperature of the first coolant or higher than the set temperature of the first coolant, the set flow rate of the first coolant is higher than the set flow rate of the second coolant, and a volume of the first tank is larger than a volume of the second tank, wherein the refrigeration circuit, the first coolant circuit, and the second coolant circuit are contained in a housing, and the supply load connection port and the return load connection port of the first coolant circuit and the supply load connection port and the return load connection port of the second coolant circuit are located outside the housing, and wherein the first coolant circuit and the second coolant circuit include a first filter and a second filter for removing physical impurities that are contained in the first coolant and the second coolant, and the first filter and the second filter are mounted on the respective supply load connection ports of the first coolant circuit and the second coolant circuit outside the housing.

2. The dual chiller according to claim 1, wherein the second coolant circuit includes a conductivity adjustment mechanism for adjusting electrical conductivity of the second coolant, the conductivity adjustment mechanism includes a DI filter for removing an ionic substance in the second coolant, a conductivity sensor for measuring the electrical conductivity of the second coolant, and a solenoid valve that opens or closes depending on the electrical conductivity that is measured by the conductivity sensor, the DI filter and the solenoid valve are connected to a filtration pipeline that connects the secondary supply pipeline and the return pipeline of the second coolant circuit to each other, and the conductivity sensor is connected to the return pipeline of the second coolant circuit.

3. The dual chiller according to claim 1, wherein the control device adjusts flow rates of the low-temperature refrigerants and high-temperature refrigerants that flow into the first heat exchanger and the second heat exchanger by correlatively adjusting the opening degrees of the first main expansion valve and the first sub expansion valve that are connected to the first heat exchanger, and the opening degrees of the second main expansion valve and the second sub expansion valve that are connected to the second heat exchanger, based on the temperatures of the first coolant and the second coolant that are measured by the first temperature sensor of the first coolant circuit and the second temperature sensor of the second coolant circuit, such that the temperatures of the first coolant and the second coolant in the first coolant circuit and the second coolant circuit are held at the set temperatures.

4. The dual chiller according to claim 1, wherein the first pump of the first coolant circuit is an immersion pump that is disposed in the first tank, and the second pump of the second coolant circuit is a non-immersion pump that is disposed outside the second tank.

* * * * *